US010641129B2

(12) United States Patent
Spangler et al.

(10) Patent No.: US 10,641,129 B2
(45) Date of Patent: May 5, 2020

(54) SUPPORT RAIL TRUSS FOR GAS TURBINE ENGINES

(71) Applicant: UNITED TECHNOLOGIES CORPORATION, Farmington, CT (US)

(72) Inventors: Brandon W. Spangler, Vernon, CT (US); Jose R. Paulino, Saco, ME (US); Craig R. McGarrah, Southington, CT (US); Edward R. Bareiss, Stafford Springs, CT (US); Edwin Otero, Southington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 300 days.

(21) Appl. No.: 15/806,830

(22) Filed: Nov. 8, 2017

(65) Prior Publication Data

US 2019/0136716 A1 May 9, 2019

(51) Int. Cl.

| | |
|---|---|
| ***F01D 25/24*** | (2006.01) |
| ***F01D 11/08*** | (2006.01) |
| ***F01D 9/04*** | (2006.01) |

(52) U.S. Cl.

CPC ..... *F01D 25/246* (2013.01); *F01D 9/04* (2013.01); *F01D 9/042* (2013.01); *F01D 11/08* (2013.01); *F05D 2220/32* (2013.01); *F05D 2230/60* (2013.01); *F05D 2240/11* (2013.01); *F05D 2240/12* (2013.01); *F05D 2250/11* (2013.01); *F05D 2250/12* (2013.01); *F05D 2250/13* (2013.01); *F05D 2250/14* (2013.01)

(58) Field of Classification Search

CPC ..... F01D 25/246; F01D 9/04; F01D 9/042; F01D 11/08; F05D 2250/11–14; F05D 2240/11–12; F05D 2230/60; F05D 2220/32; F02C 7/20

See application file for complete search history.

(56) References Cited

U.S. PATENT DOCUMENTS 2,432,359 A * 12/1947 Streid ..... F01D 25/18 60/39.08
5,165,850 A * 11/1992 Humke ..... F01D 25/24 415/135
5,181,826 A * 1/1993 Rock ..... F01D 11/18 415/171.1

(Continued)

FOREIGN PATENT DOCUMENTS

| | | |
|---|---|---|
| EP | 2166194 | 3/2010 |
| EP | 3043032 | 7/2016 |
| EP | 3118417 | 1/2017 |

OTHER PUBLICATIONS

European Patent Office, European Search Report dated Feb. 21, 2019 in Application No. 18192588.4.

*Primary Examiner* — Brian P Wolcott
(74) *Attorney, Agent, or Firm* — Snell & Wilmer, L.L.P.

(57) ABSTRACT

A component for a gas turbine engine is disclosed. The component includes a platform and a rail having an outer radial surface and an inner radial surface, with the inner radial surface connected to the platform. The rail includes a plurality of apertures spaced circumferentially between the outer radial surface and the inner radial surface, the apertures disposed to form a truss-like structure.

11 Claims, 7 Drawing Sheets

(56) References Cited

U.S. PATENT DOCUMENTS

| | | | | |
|---|---|---|---|---|
| 5,372,868 | A * | 12/1994 | Prewo | E04C 2/34 428/120 |
| 5,593,276 | A | 1/1997 | Proctor et al. | |
| 5,593,277 | A * | 1/1997 | Proctor | F01D 11/18 415/115 |
| 5,740,674 | A * | 4/1998 | Beutin | F01D 9/042 415/142 |
| 7,524,164 | B2 * | 4/2009 | Wunderlich | F01D 11/18 415/136 |
| 7,762,761 | B2 | 7/2010 | Busch et al. | |
| 8,147,192 | B2 * | 4/2012 | Jones | F01D 11/24 415/173.1 |
| 8,814,507 | B1 * | 8/2014 | Campbell | F01D 5/08 415/173.1 |
| 8,833,087 | B2 * | 9/2014 | Rice | F01D 9/04 60/751 |
| 9,587,517 | B2 * | 3/2017 | Vetters | F01D 25/246 |
| 10,138,751 | B2 * | 11/2018 | Hill | F01D 11/001 |
| 10,301,960 | B2 * | 5/2019 | Stapleton | F01D 9/042 |

* cited by examiner

SUPPORT RAIL TRUSS FOR GAS TURBINE ENGINES

GOVERNMENT LICENSE RIGHTS

This disclosure was made with government support under W58RGZ-16-C-0046 awarded by the United Stated Department of the Army. The government has certain rights in the disclosure.

FIELD

The present disclosure relates to gas turbine engines and, more particularly, to gas turbine engines having truss-like structures in the rails of various engine components, such as blade outer air seal (BOAS) supports, rings and segments.

BACKGROUND

Gas turbine engines typically include a compressor section, a combustor section and a turbine section. During operation, air is pressurized in the compressor section and mixed with fuel and burned in the combustor section to generate hot combustion gases. The hot combustion gases are communicated through the turbine section, which extracts energy from the hot combustion gases to power the compressor section and other gas turbine engine loads. One or more sections of the gas turbine engine may include a plurality of vane assemblies having vanes interspersed between rotor assemblies that carry the blades of successive stages of the section. The rotor assemblies may be disposed radially inward of a blade outer air seal (BOAS). Efficiency of operation of gas turbine engines may be enhanced by maintaining a close tolerance between the tip of rotor blades and the BOAS.

SUMMARY

A component for a gas turbine engine is disclosed. In accordance with various embodiments, the component includes a platform configured to provide a seal and a rail having an outer radial surface and an inner radial surface, with the inner radial surface connected to the platform. The rail comprises a plurality of apertures spaced circumferentially between the outer radial surface and the inner radial surface.

In various embodiments, the component is one or more of a blade outer air seal and a vane. In various embodiments, the component is one or more of a blade outer air seal support and a vane support. In various embodiments, the outer radial surface is configured to engage an engine casing structure. In various embodiments, the rail includes a hook. In various embodiments, the apertures are configured within the rail to form an outer beam, an inner beam and a plurality of connecting webs in the rail. In various embodiments, the component includes a second rail having a second outer radial surface and a second inner radial surface, with the second inner radial surface connected to the platform. In various embodiments, the second rail includes a second plurality of apertures spaced circumferentially between the second outer radial surface and the second inner radial surface.

In various embodiments, each aperture has a cross sectional shape in the form of a triangle. In various embodiments, each aperture has a width and a height, with the width being less than three times the height. In various embodiments, a distance between centers of adjacent apertures is less than two times the width. In various embodiments, each aperture has a cross sectional shape in the form of one of an equilateral triangle and an isosceles triangle. In various embodiments, each aperture has a base and a height and the bases of alternating apertures face radially inward toward a central axis. In various embodiments, pairs of adjacent apertures have a first aperture having a base facing radially inward and a second aperture having a base facing radially outward. In various embodiments, each aperture has an apex opposite the base and radial lines extending through the apexes of adjacent apertures are spaced a distance about equal to the length of each base. In various embodiments, the apertures have cross sectional shapes in the form of one or more of ellipses, rectangles and trapezoids.

A method of reducing the weight of a turbine engine component while minimizing tip gap variation between a blade tip and a blade outer air seal is disclosed. In various embodiments, the method includes providing a rail of a turbine engine component having an outer radial surface and an inner radial surface, with the inner radial surface connected to a platform of the component and providing a plurality of apertures within the rail spaced circumferentially between the outer radial surface and the inner radial surface.

In various embodiments, the turbine engine component is one or more of a blade outer air seal and a blade outer air seal support. In various embodiments, the apertures are configured within the rail to form an outer beam, an inner beam and connecting webs in the rail. In various embodiments, the apertures have a cross sectional shape in the form of one or more of ellipses, rectangles, trapezoids and triangles. In various embodiments, the apertures have a cross sectional shape in the form of one or more of triangles and trapezoids, with pairs of adjacent apertures having a first aperture having a base facing radially inward and a second aperture having a base facing radially outward to form a truss-like structure.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Figure 1:
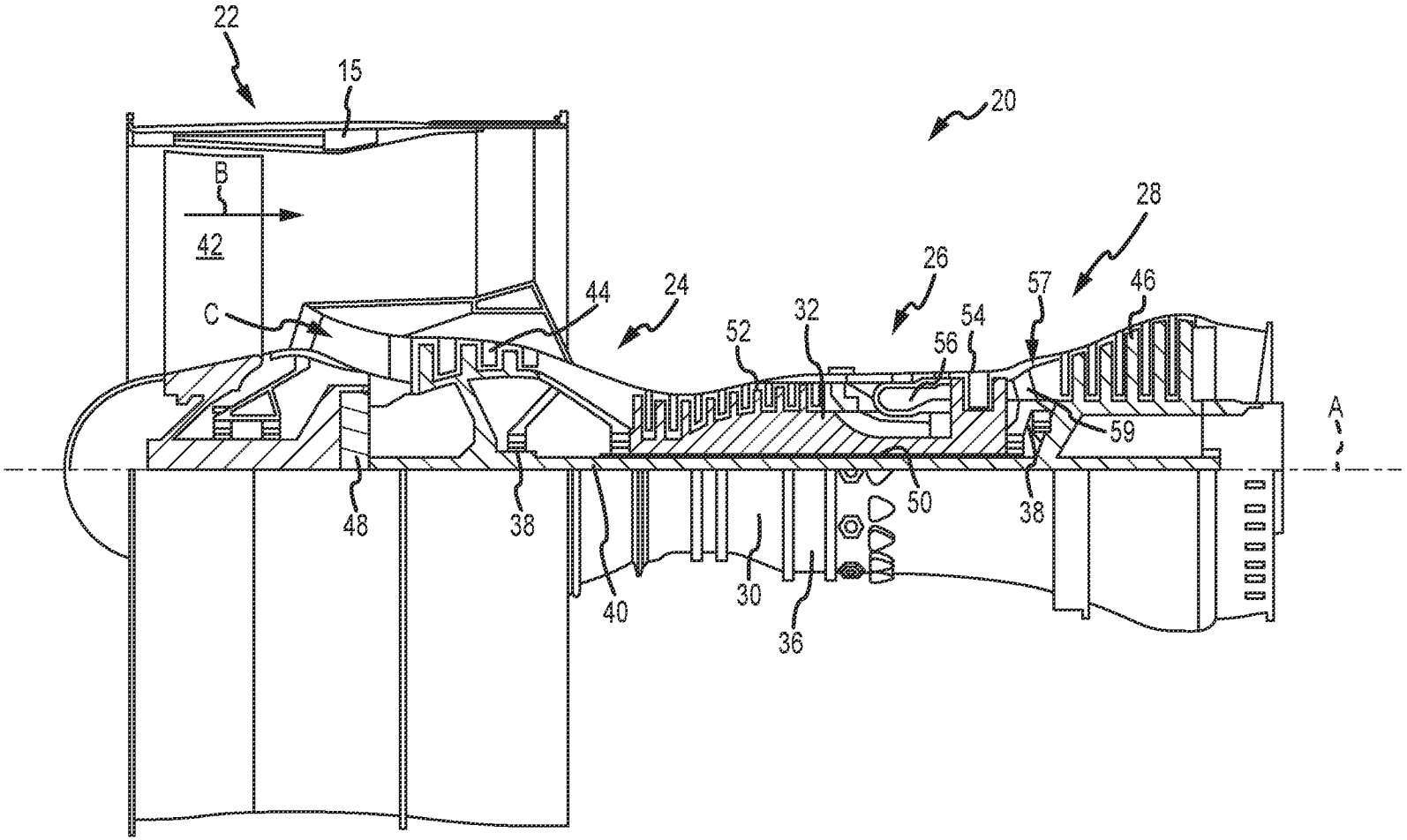
FIG. 1 is a schematic view of a gas turbine engine, in accordance with various embodiments.

Referring now to the drawings, FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core or primary flow path C for compression and communication into the combustor section 26 and then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines, including three-spool architedures.

The gas turbine engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided and the location of the bearing systems 38 may be varied as appropriate to the application. The low speed spool 30 generally includes an inner shaft 40 that interconnects a fan 42, a low pressure compressor 44 and a low pressure turbine 46. The inner shaft 40 is connected to the fan 42 through a speed change mechanism, which in this gas turbine engine 20 is illustrated as a geared architecture 48 to drive the fan 42 at a lower speed than the low speed spool 30. The high speed spool 32 includes an outer shaft 50 that interconnects a high pressure compressor 52 and a high pressure turbine 54. A combustor 56 is arranged in the gas turbine engine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via the bearing systems 38 about the engine central longitudinal axis A, which is collinear with their longitudinal axes.

The core airflow is compressed by the low pressure compressor 44 and then the high pressure compressor 52, mixed and burned with fuel in the combustor 56, and then expanded over the high pressure turbine 54 and low pressure turbine 46. The mid-turbine frame 57 includes airfoils 59 that are in the core airflow path C. The low and high pressure turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, the gear system 48 may be located aft of the combustor section 26 or even aft of the turbine section 28, and the fan section 22 may be positioned forward or aft of the location of the gear system 48.

Figure 2:
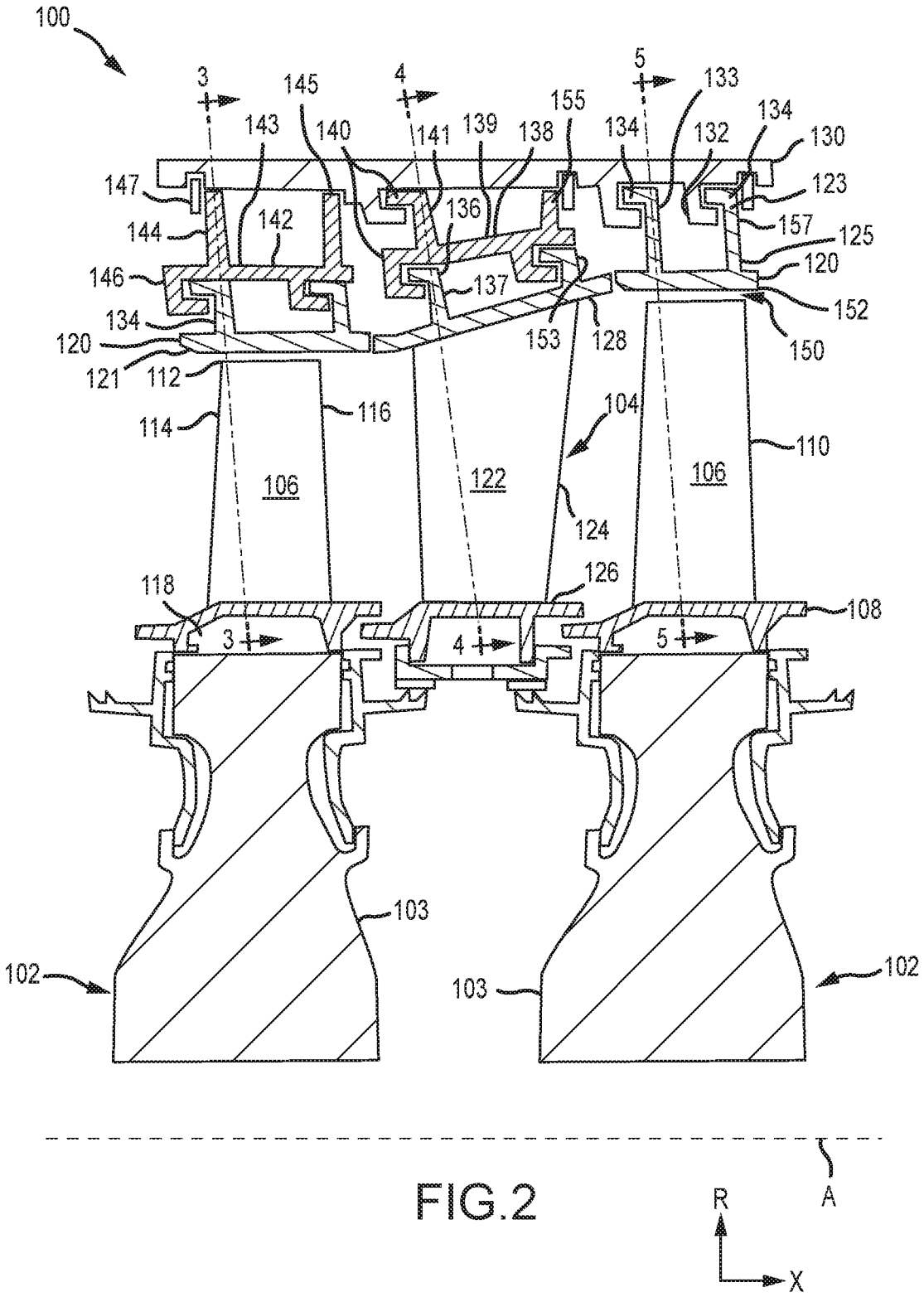
FIG. 2 illustrates a flow scheme through a portion of a turbine section of a gas turbine engine in accordance with various embodiments.

Referring now to FIG. 2, selected portions of a turbine section 100 of a gas turbine engine are illustrated. The turbine section 100 includes alternating rows of rotor assemblies 102 and vane assemblies 104. Each rotor assembly 102 carries one or more rotor blades 106 for rotation about a central axis A. Each rotor blade 106 includes a rotor platform 108 and an airfoil 110 extending in a radial direction R from the rotor platform 108 to a rotor tip 112. The airfoil 110 generally extends in a chord-wise direction X between a leading edge 114 and a trailing edge 116. A root section 118 of the rotor blade 106 is mounted to a rotor disk 103. The airfoil 110 can alternatively be integrally formed with the rotor disk 103, which is sometimes referred to as an integrally bladed rotor. A blade outer air seal (BOAS) 120 is disposed radially outward of the rotor tip 112 of the airfoil 110. The BOAS 120 includes a platform 121 configured to provide a seal to prevent hot gases from leaking outside the core airflow path C (see FIG. 1). A gap 150 exists between the rotor tip 112 and a radially inner or gas path surface 152 of the BOAS 120.

Each vane assembly 104 includes one or more vanes 122 positioned along the engine axis A and adjacent to one or more rotor blades 106. Each vane 122 includes an airfoil 124 extending between an inner vane platform 126 and an outer vane platform 128. The vane assemblies 104 are connected to an engine casing structure 130. The engine casing structure 130 includes at least one case hook 132. The case hook 132 may be segmented (i.e., does not span a full circumference) or a full circumferential hoop. The BOAS 120 and the vane assemblies 104 may be disposed radially inward of the engine casing structure 130. In various embodiments, the BOAS 120 and the vanes 122 of the turbine section 100 may be retained to the engine casing structure 130 by BOAS hooks 134 and vane hooks 136, respectively. In various embodiments, one or both of the BOAS 120 and the vane assemblies 104 may include full annular platforms or they may be segmented and include feather seals between segments to help prevent leakage of cooling fluid between the segments.

A BOAS rail 133 is positioned between the platform 121 of the BOAS 120 and the BOAS hooks 134. In various embodiments, the BOAS rail 133 includes an outer radial surface 123 configured to connect with or engage the BOAS hooks 134 and an inner radial surface 125 configured to connect with or engage the platform 121. A vane rail 137 is positioned between the outer vane platform 128 and the vane hooks 136. Like the BOAS rail 133, the vane rail 137 includes an outer radial surface configured to connect with or engage the vane hooks 136 and an inner radial surface configured to connect with or engage the outer vane platform 128.

In various embodiments, a vane support 138 extends circumferentially between the vanes 122 and the engine casing structure 130. The vane support 138 may include a vane support rail 141 and vane support hooks 140 configured to connect with or engage the case hooks 132 and the vane hooks 136. A vane support platform 139 is positioned between the vane support rail 141 and the vane support hooks 140. The vane support rail 141 includes an outer surface configured to connect with or engage an inner surface of the engine casing structure 130 and an inner radial surface configured to connect with or engage the vane support platform 139.

In various embodiments, a BOAS support 142 extends circumferentially between the BOAS 120 and the engine casing structure 130. The BOAS support 142 may include a BOAS support rail 144 configured to abut the engine casing structure 130 and BOAS support hooks 146 that connect with the BOAS hooks 134. Similar to the vane support 138, a BOAS support platform 143 is positioned between the BOAS support rail 144 and the BOAS support hooks 146. Like the vane support rail 141, the BOAS support rail 144 includes an outer radial surface configured to connect with or engage an inner surface of the engine casing structure 130 and an inner radial surface configured to connect with or engage the BOAS support platform 143.

In various embodiments, one or more retaining rings 147 may be employed to retain the BOAS support 142, the vane support 138 or the BOAS 120 from axial movement relative to the engine casing structure 130.

The vane hooks 136, in combination with the vane support 138, are used to achieve radial and axial attachment of the vanes 122 relative to the engine casing structure 130. Similarly, the BOAS hooks 134, either alone or in combination with the BOAS support 142, are used to achieve radial and axial attachment of the BOAS 120 relative to the engine casing structure 130. In various embodiments, the BOAS hooks 134 and the vane hooks 136 are mated with and received by the case hooks 132 of the engine casing structure 130 or respective BOAS support hooks 146 and vane support hooks 140. In various embodiments, a plurality of BOAS hooks 134 and vane hooks 136, respectively, retain the BOAS 120 and the vanes 122 to the engine casing structure 130 or to, respectively, the BOAS support 142 and the vane support 138, to affect a working seal for the core airflow path and to maintain the gap 150 during gas turbine engine operation.

Figure 3:
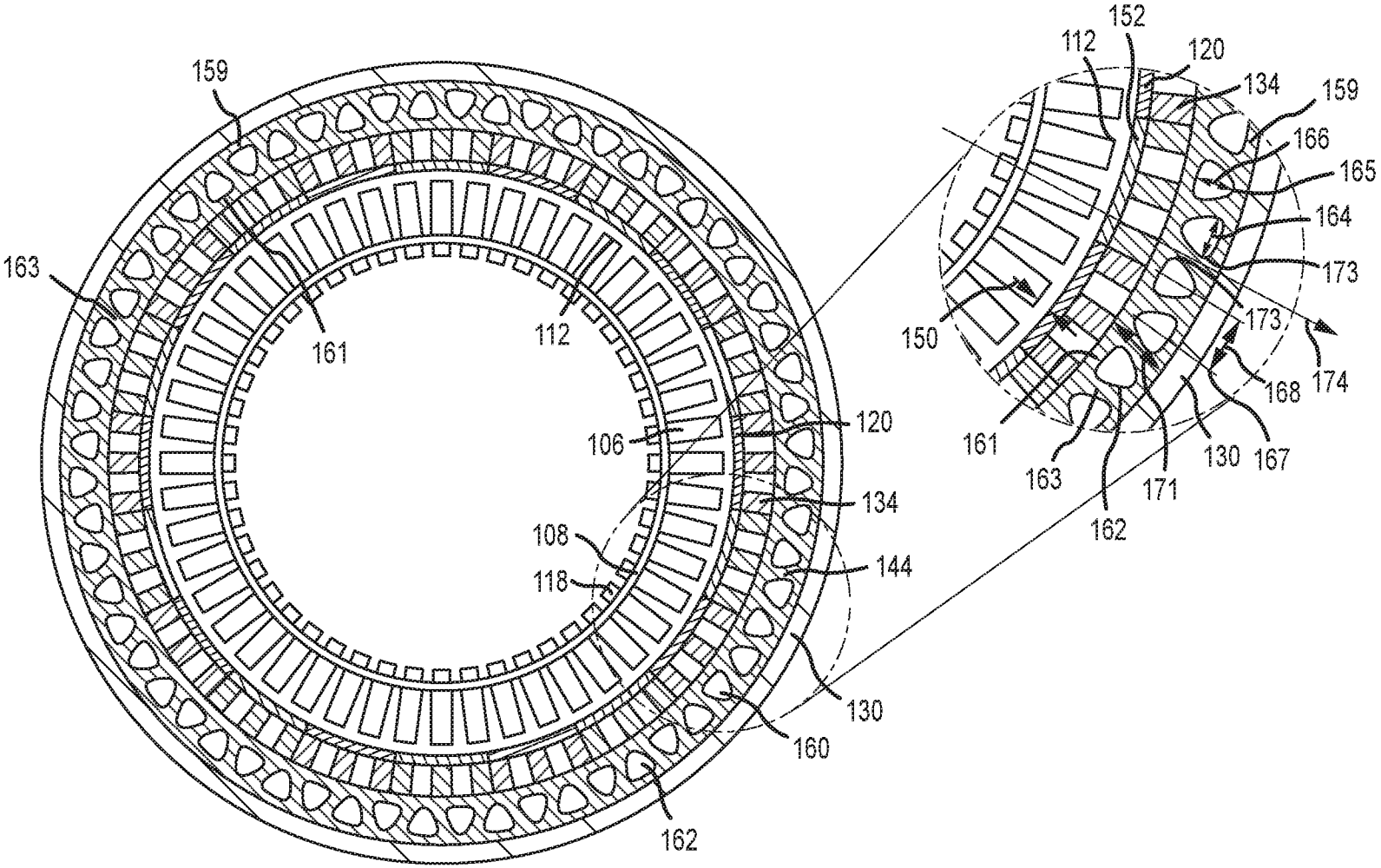
FIG. 3 provides a cross sectional view, along the line 3-3 in FIG. 2, of a rotor blade, BOAS and BOAS support configuration, according to various embodiments.

Referring now to FIG. 3, a sectional view along the line 3-3 in FIG. 2 is shown. The engine casing structure 130 extends circumferentially about the central axis A, as illustrated in FIG. 2. Radially inward of the engine casing structure 130 is the BOAS support rail 144 followed by the BOAS hooks 134 and then the BOAS 120. The engine casing structure 130, the BOAS support rail 144, the BOAS hooks 134 and the BOAS 120 provide an outer structure and seal, within which the rotor assemblies 102 rotate about the central axis A as indicated in FIG. 2. In various embodiments, a second BOAS support rail 145 (see FIG. 2) may be included, with the second BOAS support rail 145 including the characteristics and features of the BOAS support rail 144 described above and below. Shown radially inward of the BOAS 120 are the rotor blades 106 and the rotor platforms 108. The BOAS 120 and the rotor tips 112 are separated by the gap 150 (see FIG. 2). The BOAS support rail 144 includes a plurality of apertures 160. The plurality of apertures 160 are spaced closely and regularly in the BOAS support rail 144 to create an outer beam 159, an inner beam 161, and connecting webs 163. The resulting rail structure is lighter than a rail structure without apertures while having closely and regularly spaced apertures reduces stresses and minimizes deformation compared to having apertures spaced farther apart.

In various embodiments, the apertures 160 are triangular shaped apertures 162 in cross section. The triangular shaped apertures 162, spaced closely and regularly about the circumference of the BOAS support rail 144, create a truss-like rail structure with an outer beam 159, an inner beam 161, and connecting webs 163. The truss-like rail structure provides the lowest stresses and least amount of deformation. In various embodiments, the apertures may have characteristics of equilateral triangles or isosceles triangles. In various embodiments, the apertures may have characteristics of scalene triangles—e.g., triangles where all sides have different lengths.

In various embodiments, the triangular shaped apertures 162 include a base 164, an apex 165 and a height 166 and are separated by a distance 168. In various embodiments, the BOAS support rail 144 may include a radial length 171 between an outer radial surface and an inner radial surface that extends radially between the engine casing structure 130 and the BOAS hooks 134. In various embodiments, the base 164 of each of the triangular shaped apertures 162 has a length that is the same as the distance 168 that separates each of the apertures, which results in base vertices 173 of adjacent triangular shaped apertures 162 being positioned on a common radial line 174 extending between the adjacent apertures. In various embodiments, the base 164 of each of the triangular shaped apertures 162 has a length that is less than the distance 168 that separates each of the apertures, which results in base vertices 173 of adjacent triangular shaped apertures 162 being separated a circumferential distance with respect to the common radial line 174 extending between the adjacent apertures. In various embodiments, the base 164 of each of the triangular shaped apertures 162 has a length that is greater than the distance 168 that separates each of the apertures, which results in base vertices 173 of adjacent triangular shaped apertures 162 overlapping in a circumferential direction with respect to the common radial line 174 extending between the adjacent apertures.

In various embodiments, the height 166 of the triangular shaped apertures 162 is between about one-quarter and about three-quarters the radial length 171. In various embodiments, the height 166 of the triangular shaped apertures 162 is about one-half the radial length 171. In various embodiments, the apertures 160 or triangular shaped apertures 162 have sides or vertices that are curved to aid in manufacturing or to reduce stress concentrations. In various embodiments, the triangular shaped apertures 162 are disposed circumferentially about the BOAS support rail 144 such that the bases 164 of alternating apertures face radially inward. In various embodiments, pairs of adjacent triangular shaped apertures 162 have a first aperture having a base 164 facing radially inward and a second aperture having a base 164 facing radially outward. In various embodiments, the apex 165 of each triangular shaped aperture 162 is positioned opposite the base 164 and radial lines 167 extending through the apexes 165 of adjacent apertures are spaced a distance 168 about equal to the length of each base 164.

Figure 4:
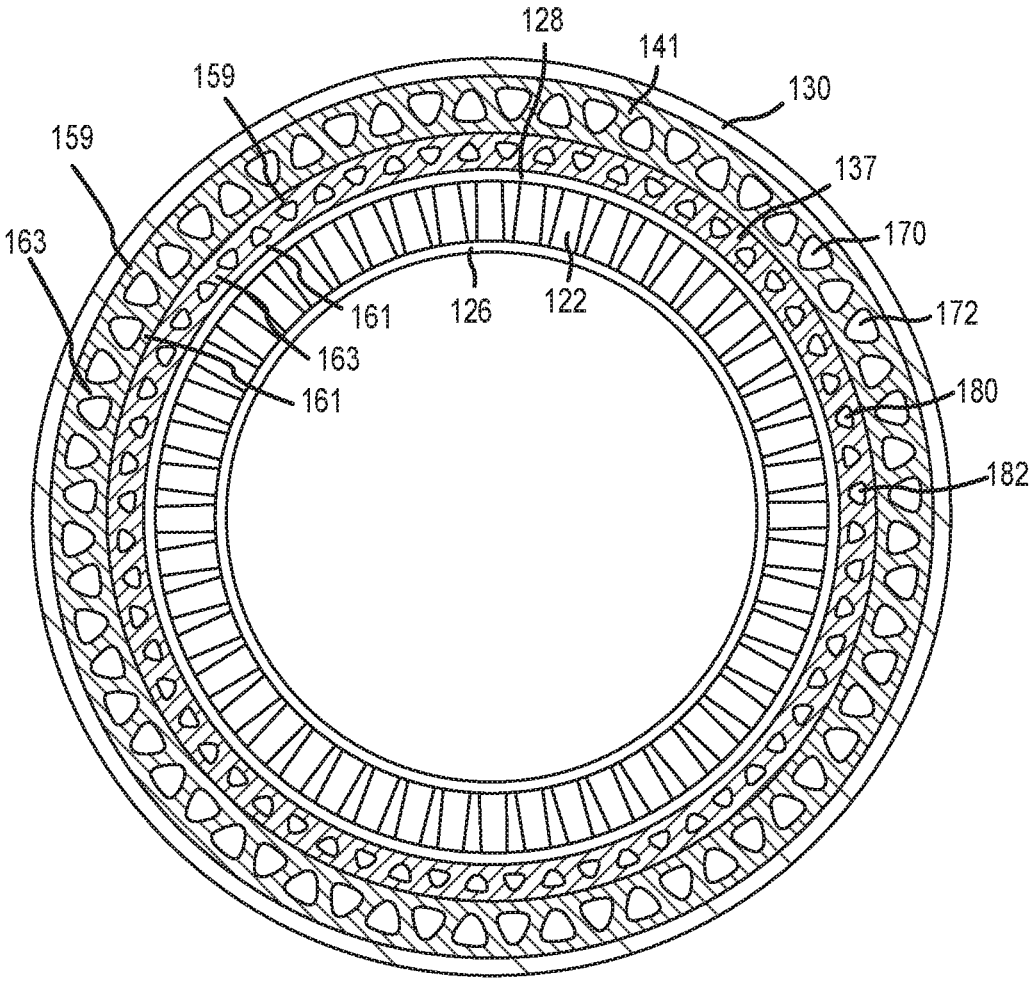
FIG. 4 provides a cross sectional view, along the line 4-4 in FIG. 2, of a vane, vane platform and vane support configuration, according to various embodiments.

Referring now to FIG. 4, a sectional view along the line 4-4 in FIG. 2 is shown. The engine casing structure 130 extends circumferentially about the central axis A, as illustrated in FIG. 2. Radially inward of the engine casing structure 130 is the vane support rail 141 followed by the vane rail 137 and then the outer vane platform 128. The engine casing structure 130, the vane support rail 141, the vane rail 137 and the outer vane platform provide 128 an outer structure, within which the vanes 122 and inner vane platforms 126 are fixedly secured about the central axis A as indicated in FIG. 2. In various embodiments, a second vane support rail 155 (see FIG. 2) or a second vane rail 153 (see FIG. 2) may be included, with the second vane support rail 155 and the second vane rail 153 including the characteristics and features of the vane support rail 141 and the vane rail 137 described above and below. The vane support rail 141 includes a plurality of apertures 170. In various embodiments, the apertures 170 are triangular shaped apertures 172 in cross section. In various embodiments, the vane rail 137 also includes a plurality of apertures 180. In various embodiments, the apertures 180 are triangular shaped apertures 182 in cross section. In various embodiments, the apertures 170 or the triangular shaped apertures 172 positioned in the vane support rail 141 share the same dimensional characteristics with respect to a radial length of the vane support rail 141 as described above with reference to FIG. 3. In various embodiments, the apertures 180 or the triangular shaped apertures 182 positioned in the vane rail 137 share the same dimensional characteristics with respect to a radial length of the vane rail 137 as described above with reference to FIG. 3.

Figure 5:
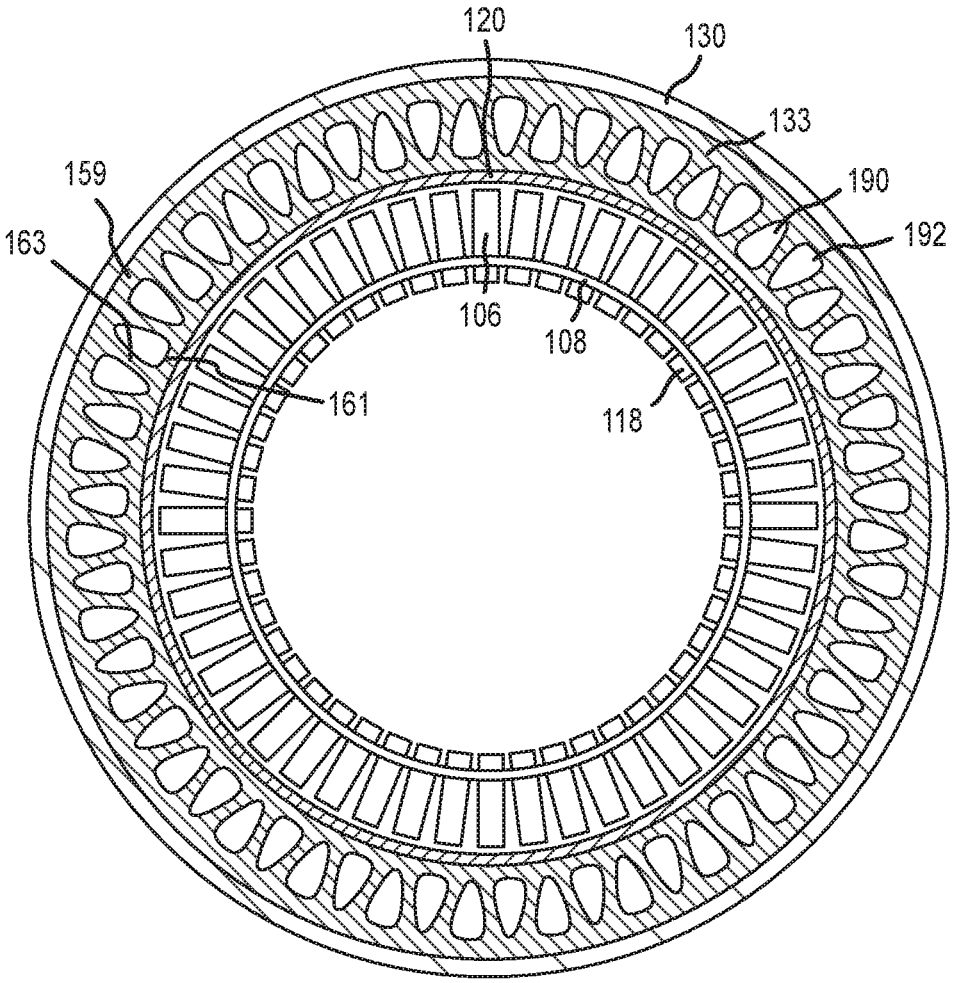
FIG. 5 provides a cross sectional view, along the line 5-5 in FIG. 2, of a rotor blade, and BOAS configuration, according to various embodiments.

Referring now to FIG. 5, a sectional view along the line 5-5 in FIG. 2 is shown. The engine casing structure 130 extends circumferentially about the central axis A, as illustrated in FIG. 2. Radially inward of the engine casing structure 130 is the BOAS rail 133 followed by the BOAS 120. The engine casing structure 130, the BOAS rail 133 and the BOAS 120 provide an outer structure and seal, within which the rotor assemblies 102 rotate about the central axis A as indicated in FIG. 2. In various embodiments, a second BOAS rail 157 (see FIG. 2) may be included, with the second BOAS rail 157 including the characteristics and features of the BOAS rail 133 described above and below. Shown radially inward of the BOAS 120 are the rotor blades 106 and the rotor platforms 108. The BOAS 120 and the rotor tips 112 are separated by the gap 150 (see FIG. 2). The BOAS rail 133 includes a plurality of apertures 190. In various embodiments, the apertures 190 are triangular shaped apertures 192 in cross section. In various embodiments, the apertures 190 or the triangular shaped apertures 192 positioned in the BOAS rail 133 share the same dimensional characteristics with respect to a radial length of the BOAS rail 133 as described above with reference to FIG. 3.

Figure 6B:
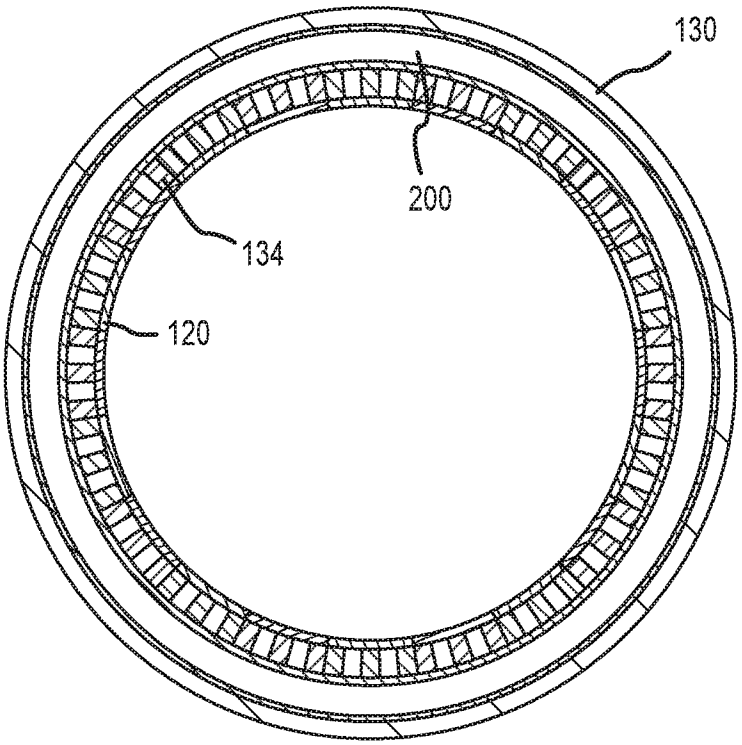
FIGS. 6A and 6B provides sectional view of a BOAS and BOAS support configuration, in accordance with various embodiments.
Figure 6A:
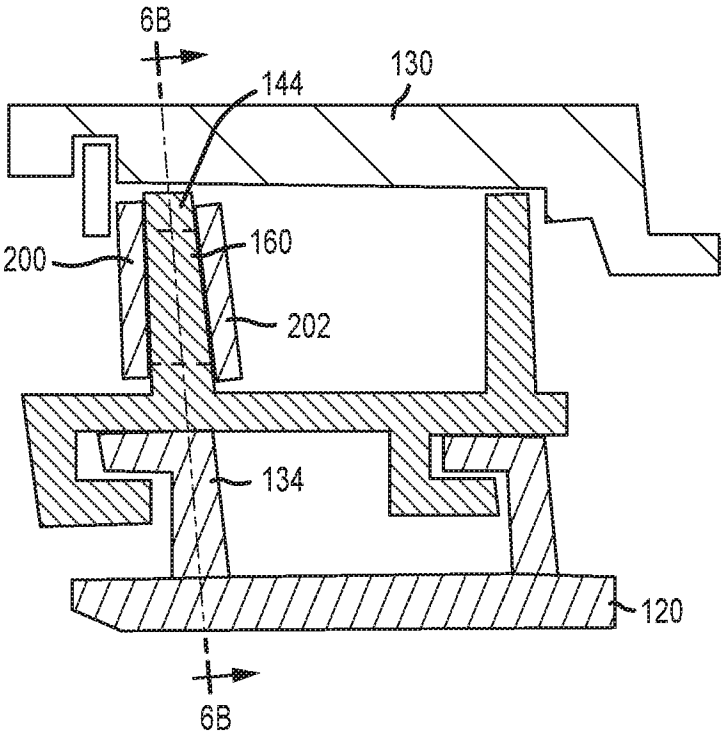

Referring now to FIGS. 6A and 6B, a sectional view along a radially outer portion of the line 3-3 in FIG. 2 is shown with the inclusion of cover plates positioned over the BOAS support rail 144. Similar to the embodiments described with reference to FIG. 2, the engine casing structure 130 extends circumferentially about the central axis A. Radially inward of the engine casing structure 130 is the BOAS support rail 144 followed by the BOAS hooks 134 and then the BOAS 120. The engine casing structure 130, the BOAS support rail 144, the BOAS hooks 134 and the BOAS 120 provide an outer structure, within which the rotor assemblies 102 rotate about the central axis A, as indicated in FIG. 2. The BOAS support rail 144 includes a plurality of apertures 160. In various embodiments, the apertures 160 are covered by a first cover plate 200 on one side of the BOAS support rail 144. The first cover plate 200 provides a seal to prevent flow leakage through the apertures 160 from one side of the BOAS support rail 144 to the other side during operation. In various embodiments, a second cover plate 202 may be attached to the second side of the BOAS support rail 144. In various embodiments, the first cover plate 200 or the second cover plate 202 comprise full circumferential hoops. In various embodiments, the first cover plate 200 or the second cover plate 202 comprise circumferential segments. In various embodiments, the first cover plate 200 or the second cover plate 202 are welded, brazed or riveted to the BOAS support rail 144. In various embodiments, the first cover plate 200 or the second cover plate 202 are constructed of sheet metal.

Figure 7A:
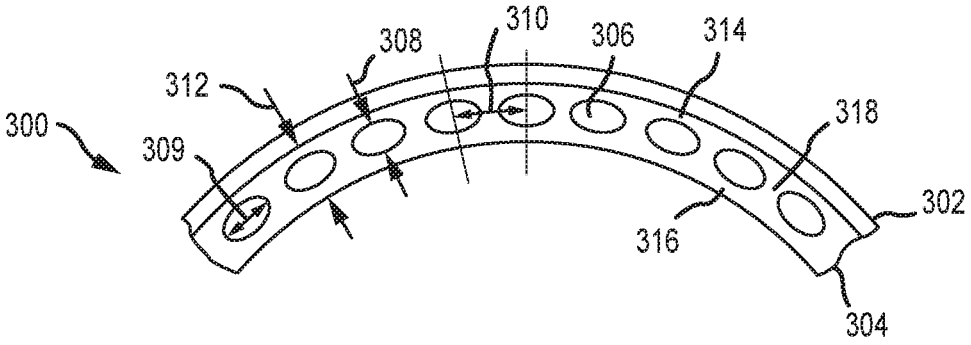
FIGS. 7A, 7B and 7C provide sectional views of rails having different aperture embodiments, in accordance with various embodiments.
Figure 7B:
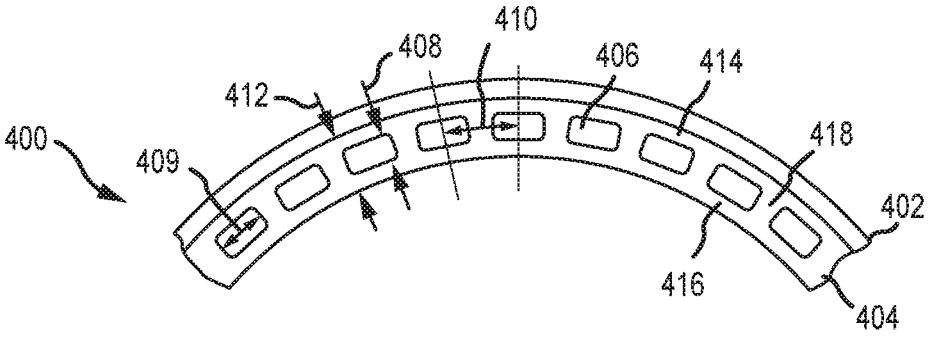
Figure 7C:
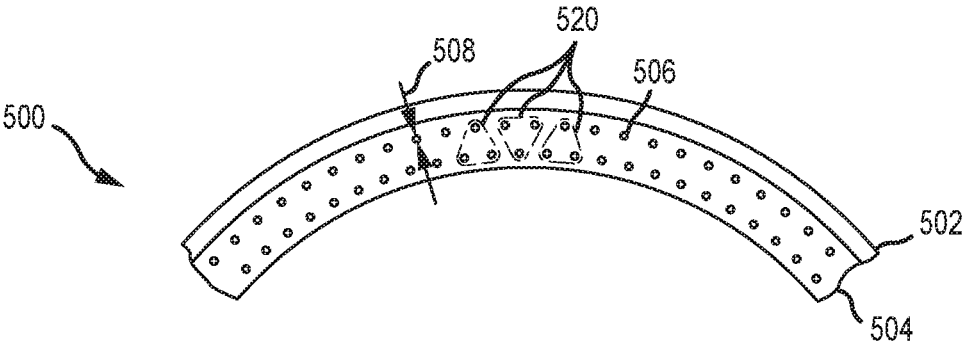

Referring now to FIGS. 7A, 7B and 7C, various aperture profiles and arrangements that may be employed in the BOAS and vane support rails described above are illustrated. Referring to FIG. 7A, a support rail structure 300 is illustrated. The support rail structure 300 includes an engine casing structure 302 and a support rail 304. The support rail 304 may be used in any of the BOAS, vane, BOAS support or vane support embodiments described above. A plurality of apertures 306 in the form of ellipses is positioned along the circumference of the support rail 304 to create an outer beam 314, inner beam 316, and connecting webs 318. The apertures 306 have a radial height 308 and circumferential width 309. Similar to the above described embodiments, the apertures are spaced closely and regularly about the circumference of the support rail 304 in order to minimize the amount of stress and deformation seen in the outer beam 314, the inner beam 316, and the connecting webs 318. In various embodiments, the circumferential width 309 is less than about three times the radial height 308. The apertures 306 are spaced a circumferential distance 310 from center to center about the circumference of the support rail 304. In various embodiments, the circumferential distance 310 between the centers of adjacent apertures 306 is less than about twice the circumferential width 309 of the apertures 306. The support rail 304 may also be characterized as having a radial length 312, extending from a radially inner surface of the engine casing structure 302 to an outer surface of the BOAS hooks (e.g., a radially outer surface of the BOAS hooks 134 illustrated in FIG. 6A). In various embodiments, the radial height 308 of the apertures 306 is about one-half the radial length 312 of the support rail 304.

Referring to FIG. 7B, a support rail structure 400 is illustrated. The support rail structure 400 includes an engine casing structure 402 and a support rail 404. The support rail 404 may be used in any of the BOAS, vane, BOAS support, or vane support embodiments described above. A plurality of apertures 406 in the form of rectangles is positioned along the circumference of the support rail 404 to create an outer beam 414, inner beam 416, and connecting webs 418. In various embodiments, the apertures 406 may have fillets that round the corners of the rectangles. The apertures 406 have a radial height 408 and circumferential width 409. Similar to the above described embodiments, the apertures are spaced closely and regularly about the circumference of the support rail 404 in order to minimize the amount of stress and deformation seen in the outer beam 414, inner beam 416, and connecting webs 418. In various embodiments, the circumferential width 409 is less than about three times the radial height 408. The apertures 406 are spaced a circumferential distance 410 from center to center about the circumference of the support rail 404. In various embodiments, the circumferential distance 410 between the centers of adjacent apertures 406 is less than about twice the circumferential width 409 of the apertures 406. The file support rail may also be characterized as having a radial length 412, extending from a radially inner surface of the engine casing structure 402 to an outer surface of the BOAS hooks (e.g., a radially outer surface of the BOAS hooks 134 illustrated in FIG. 6A). In various embodiments, the radial height 408 of the apertures 406 is about one-half the radial length 412 of the support rail 404. In various embodiments, the apertures 406 take the form of trapezoids, where one or more of opposing sides of the rectangular-shaped apertures is unequal in length—e.g., the radially innermost side of a rectangle has a length different from the length of the radially outermost side of the rectangle or the four corners of a rectangle do not each share ninety degree angles between adjacent sides.

Referring to FIG. 7C, a support rail structure 500 is illustrated. The support rail structure 500 includes an engine casing structure 502 and a support rail 504. The support rail 504 may be used in any of the BOAS, vane, BOAS support, or vane support embodiments described above. A plurality of apertures 506 in the form of circles is positioned along the circumference of the support rail 504. Similar to the above described embodiments, the apertures are spaced closely and regularly about the circumference of the support rail 504. Referring to the embodiments described with reference to FIG. 3, the apertures 506 may be positioned proximate the vertices of the apertures 160 illustrated in FIG. 3. Referring to FIG. 7C, triangular outlines 520 illustrate the positioning of the apertures 506 with reference to the vertices of the apertures 160 illustrated and described with reference to FIG. 3. In various embodiments, the apertures 506 have a circumference 508 that is small with respect to the base 164 or height 166 of the apertures 160 illustrated in FIG. 3. In various embodiments, the circumference 508 of the apertures 506 is about one-fourth to about one-half the base 164 of the apertures 160 illustrated in FIG. 3. In various embodiments, the circumference 508 of the apertures 506 is about one-fourth to about one-half the height 166 of the apertures 160 illustrated in FIG. 3.

The foregoing disclosure provides a manner by which weight may be taken out of a rail of a gas turbine engine component while controlling and minimizing stresses and deformations. When incorporated in a BOAS or BOAS support, the reduced deformations allow the tip gap between the BOAS and the blade tip to be tightly controlled. While the disclosure has been presented using apertures having triangular, elliptical, rectangular, and circular shapes, those skilled in the art will appreciate that other shapes may be employed, such as squares, diamonds, trapezoids, and polygons of general shape and number of sides. Further, while the disclosure focuses on turbine sections of gas turbine engines, the disclosure extends to other sections of gas turbine engines, including, but not limited to compressor sections.

Finally, it should be understood that any of the above described concepts can be used alone or in combination with any or all of the other above described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed:

1. A turbine engine component, comprising:

a platform disposed radially outward of at least one of a rotor assembly and a vane assembly and a rail having an outer radial surface and an inner radial surface, the inner radial surface connected to the platform, wherein the rail comprises a plurality of apertures spaced circumferentially between the outer radial surface and the inner radial surface, the plurality of apertures configured within the rail to form an outer beam, an inner beam and connecting webs in the rail and wherein each aperture has a cross sectional shape in the form of a triangle having a base and a height, with each pair of adjacent apertures defining a first aperture having a base facing radially inward and a second aperture having a base facing radially outward with respect to an engine central longitudinal axis.

2. The turbine engine component of claim 1, wherein the component is one or more of a blade outer air seal support and a vane support.

3. The turbine engine component of claim 1, wherein the outer radial surface is configured to engage an engine casing structure.

4. The turbine engine component of claim 1, wherein the rail includes a hook.

5. The turbine engine component of claim 1, further comprising a second rail having a second outer radial surface and a second inner radial surface, the second inner radial surface connected to the platform, wherein the second rail comprises a second plurality of apertures spaced circumferentially between the second outer radial surface and the second inner radial surface.

6. The turbine engine component of claim 1, wherein each aperture has a width and a height, the width being less than three times the height.

7. The turbine engine component of claim 6, wherein a distance between centers of adjacent apertures is less than two times the width.

8. The turbine engine component of claim 1, wherein each aperture has a cross sectional shape in the form of one of an equilateral triangle and an isosceles triangle.

9. The turbine engine component of claim 1, wherein each aperture has an apex opposite the base and wherein radial lines extending through the apexes of adjacent apertures are spaced a distance equal to the length of each base.

10. A method of reducing weight of a turbine engine component while minimizing tip gap variation between a blade tip and a blade outer air seal, the method comprising:

connecting an inner radial surface of a rail of a gas turbine engine component to a platform of the component, the platform configured for disposition radially outward of at least one of a rotor assembly and a vane assembly and the rail comprising an outer radial surface and forming a plurality of apertures within the rail spaced circumferentially between the outer radial surface and the inner radial surface, the plurality of apertures configured within the rail to form an outer beam, an inner beam and connecting webs in the rail, wherein each aperture has a cross sectional shape in the form of a triangle having a base and a height, with each pair of adjacent apertures defining a first aperture having a base facing radially inward and a second aperture having a base facing radially outward with respect to an engine central longitudinal axis.

11. The method of claim 10, wherein the turbine engine component is one or more of a blade outer air seal and a blade outer air seal support.

* * * * *